US009426592B2

(12) United States Patent
Skoglund et al.

(10) Patent No.: US 9,426,592 B2
(45) Date of Patent: Aug. 23, 2016

(54) AUDIO CLIPPING DETECTION

(71) Applicants: Jan Skoglund, Mountain View, CA (US); Jan Thomas Linden, Mountain View, CA (US)

(72) Inventors: Jan Skoglund, Mountain View, CA (US); Jan Thomas Linden, Mountain View, CA (US)

(73) Assignee: GOOGLE INC., Mountain View, CA (US)

( * ) Notice: Subject to any disclaimer, the term of this patent is extended or adjusted under 35 U.S.C. 154(b) by 481 days.

(21) Appl. No.: 13/767,387

(22) Filed: Feb. 14, 2013

(65) Prior Publication Data

US 2014/0226829 A1 Aug. 14, 2014

(51) Int. Cl.
*H04R 29/00* (2006.01)
*G10L 25/69* (2013.01)

(52) U.S. Cl.
CPC ..... *H04R 29/00* (2013.01); *G10L 25/69* (2013.01)

(58) Field of Classification Search
CPC ..... H04R 29/00
See application file for complete search history.

(56) References Cited

U.S. PATENT DOCUMENTS

| | | | | |
|---|---|---|---|---|
| 5,822,718 | A * | 10/1998 | Bakis et al. | 702/180 |
| 6,651,040 | B1 | 11/2003 | Bakis et al. | |
| 2006/0122831 | A1 | 6/2006 | Jeong et al. | |
| 2010/0030555 | A1 | 2/2010 | Otani et al. | |

FOREIGN PATENT DOCUMENTS

EP 1033817 A1 9/2000

* cited by examiner

*Primary Examiner* — Paul Huber
(74) *Attorney, Agent, or Firm* — Birch, Stewart, Kolasch & Birch, LLP

(57) ABSTRACT

Methods and systems for detecting the presence and frequency of clipping in an audio signal are provided. A clipping detection algorithm detects the presence of hard and soft clipping using histograms with intervals of samples, rather than attempting to identify the clipping value. Therefore, it is not essential to the algorithm that there be a large number of bins. Furthermore, the bins may be non-uniformly distributed since the number of samples belonging to lower amplitudes is of little importance. The detection algorithm is also configured to determine the severity and/or perceptual effect of any clipping found to be present in the signal by calculating the ratio of clipped samples to non-clipped samples. Temporal information on the occurrence of clipping in the signal is also used to evaluate perceptual effect.

20 Claims, 9 Drawing Sheets

AUDIO CLIPPING DETECTION

TECHNICAL FIELD

The present disclosure generally relates to methods and systems for digital signal processing. More specifically, aspects of the present disclosure relate to detecting the presence and frequency of audio clipping using histograms with sample intervals.

BACKGROUND

In digital audio processing the samples are represented by a certain fixed-sized data type. A typical representation is 16-bit signed integers. The format limits the range of possible values of the data. In the 16 bit-example the data range is [−32768, 32767]. If the result from data manipulation, as for example a scaling, would yield a desired value outside this range, the processed data point will be truncated to the range limits. This problem is often referred to as clipping or saturation. This type of distortion is severely degrading the audio quality of the signal and it is crucial to avoid clipping and try to detect it wherever it can appear. An occurrence of as little as 0.01% clipping can be displeasing to the audio experience.

FIG. 1 illustrates an undistorted speech signal and FIG. 2 illustrates a clipped signal. The amplitude scales in FIGS. 1 and 2 are normalized. It should be noted that the clipped signal illustrated in FIG. 2 is not maxed-out at full scale, which could occur, for example, when the signal is scaled down or the processing after the clipping has higher resolution.

The type of clipping discussed above, where the clipping results in two values (one for positive sample values, and one for negative sample values, one or both may be equal to the maximum amplitude) is also referred to as "hard clipping". In one approach, a simple detection algorithm can detect such clipping for constant sequences of the maximum and minimum sample values. Another approach, which uses a more advanced method based on the same principle, attempts to detect another clipping level in addition to the maximum and minimum values. This can occur if, for example, the signal has been scaled after being clipped.

However, in many cases there could be subsequent processing occurring (e.g., filtering where the clipped samples are dispersed). This so-called "soft clipping" can also be the result of non-linear compression in either the analog chain prior to digitization or a digital amplitude decompression. An example of soft clipping is shown in FIG. 3. Soft clipping cannot be detected with the simple algorithm of the approaches described above.

SUMMARY

This Summary introduces a selection of concepts in a simplified form in order to provide a basic understanding of some aspects of the present disclosure. This Summary is not an extensive overview of the disclosure, and is not intended to identify key or critical elements of the disclosure or to delineate the scope of the disclosure. This Summary merely presents some of the concepts of the disclosure as a prelude to the Detailed Description provided below.

One embodiment of the present disclosure relates to a method for detecting audio clipping, the method comprising: calculating a histogram for an audio signal; determining a local maximum in a range of bins of the histogram; comparing the local maximum with at least one other characteristic of the histogram; and determining whether clipping is present in the audio signal based on the comparison.

In another embodiment of the method for detecting audio clipping, the step of determining whether clipping is present in the audio signal based on the comparison includes determining whether a ratio of the local maximum and the at least one other characteristic of the histogram exceeds a predetermined threshold value.

In another embodiment, the method for detecting audio clipping further comprises, in response to the ratio exceeding the predetermined threshold value, determining that clipping is present in the signal.

In yet another embodiment, the method for detecting audio clipping further comprises determining a value for the clipping in the signal.

In still another embodiment, the method for detecting audio clipping further comprises determining perceptual effect of the clipping based on a ratio of clipped samples of the signal to non-clipped samples of the signal.

In still a further embodiment, the method for detecting audio clipping further comprises calculating a ratio of clipped samples of the signal to non-clipped samples of the signal; and determining perceptual effect of the clipping based on the calculated ratio.

In yet another embodiment, the method for detecting audio clipping further comprises determining perceptual effect of the clipping based on temporal information about the clipping.

In one or more other embodiments, the method presented herein may optionally include one or more of the following additional features: the determination of the value for the clipping is performed as post-processing; the range of bins is at an end of a tail of the histogram; the bins of the histogram correspond to amplitude intervals; the bins of the histogram are non-uniformly distributed across the histogram; the at least one other characteristic of the histogram is a histogram value of at least one bin outside of the range of bins; the histogram value of the at least one bin outside the range of bins is a local average of histogram values of bins outside of the range of bins; the at least one other characteristic of the histogram is a histogram value of at least one neighboring bin of the range of bins; the histogram value of the at least one neighboring bin of the range of bins is a local average of histogram values of neighboring bins of the range of bins; the histogram value of the at least one neighboring bin of the range of bins is a local average of log-histogram values of neighboring bins of the range of bins; the temporal information includes a number of clippings in the signal over a period of time; the temporal information includes a frequency of clippings in the signal over a period of time; and/or the determination of whether clipping is present in the signal is used as a consideration in applying a digital gain control algorithm.

Further scope of applicability of the present disclosure will become apparent from the Detailed Description given below. However, it should be understood that the Detailed Description and specific examples, while indicating preferred embodiments, are given by way of illustration only, since various changes and modifications within the spirit and scope of the disclosure will become apparent to those skilled in the art from this Detailed Description.

BRIEF DESCRIPTION OF DRAWINGS

These and other objects, features and characteristics of the present disclosure will become more apparent to those skilled in the art from a study of the following Detailed Description in conjunction with the appended claims and drawings, all of which form a part of this specification. In the drawings:

Figure 1:
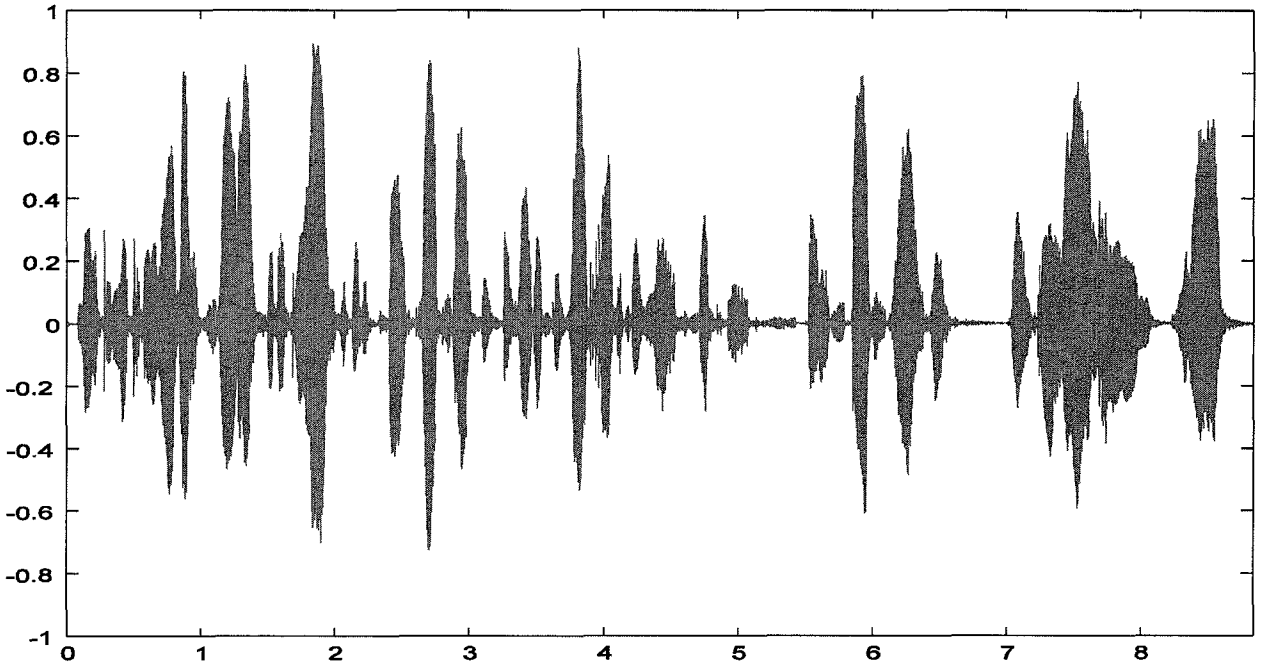
FIG. 1 is a graphical representation illustrating an undistorted speech signal.
Figure 2:
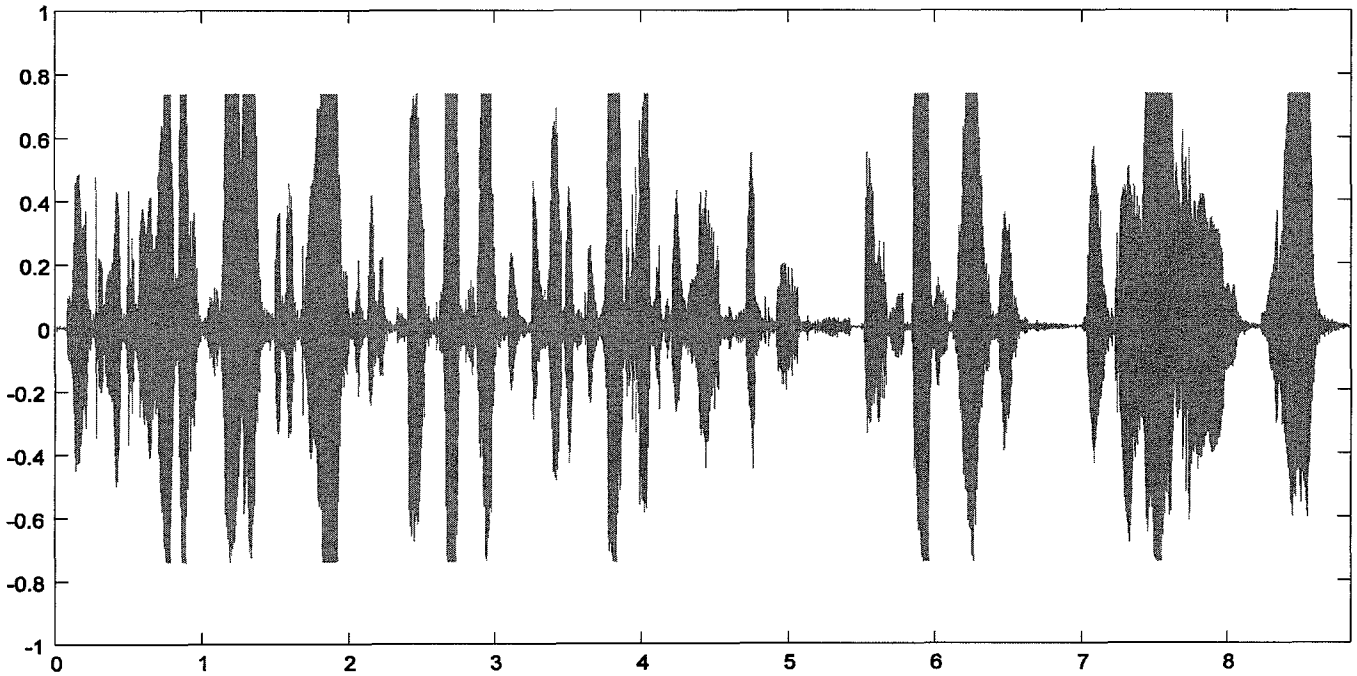
FIG. 2 is a graphical representation illustrating a hard-clipped speech signal.
Figure 3:
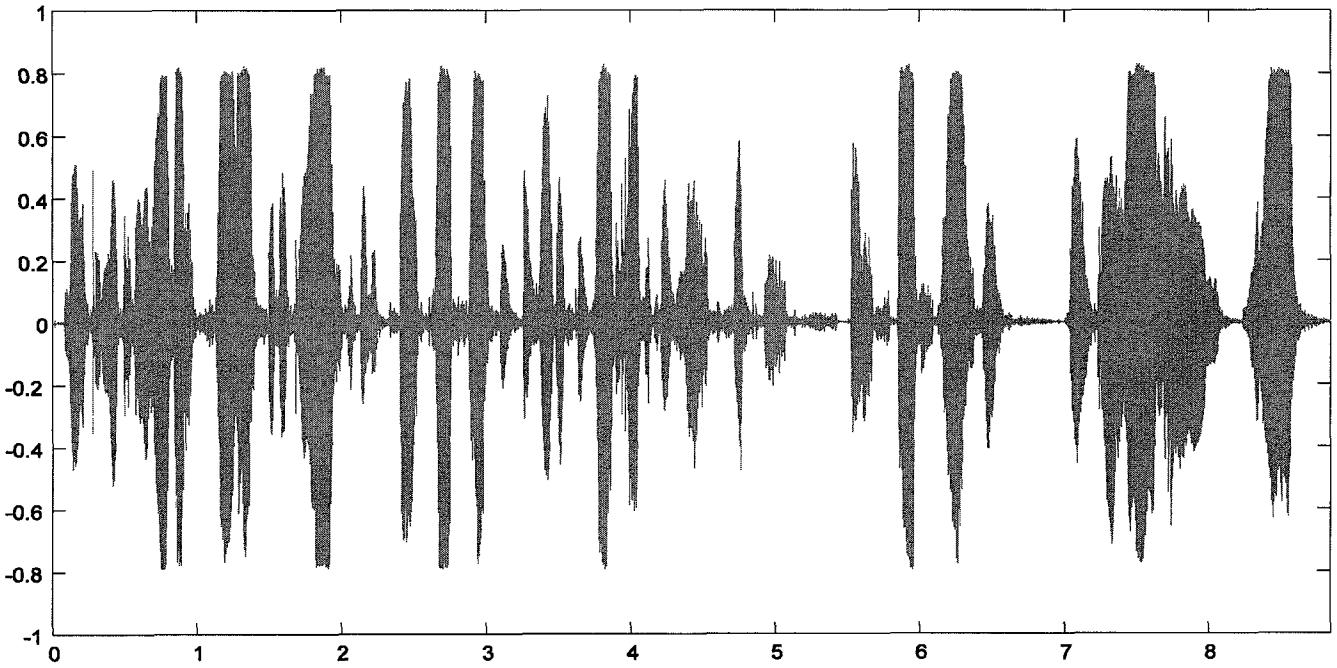
FIG. 3 is a graphical representation illustrating a soft-clipped speech signal.

The headings provided herein are for convenience only and do not necessarily affect the scope or meaning of the claims.

In the drawings, the same reference numerals and any acronyms identify elements or acts with the same or similar structure or functionality for ease of understanding and convenience. The drawings will be described in detail in the course of the following Detailed Description.

DETAILED DESCRIPTION

Various examples and embodiments will now be described. The following description provides specific details for a thorough understanding and enabling description of these examples. One skilled in the relevant art will understand, however, that the embodiments described herein may be practiced without many of these details. Likewise, one skilled in the relevant art will also understand that one or more embodiments can include many other obvious features not described in detail herein. Additionally, some well-known structures or functions may not be shown or described in detail below, so as to avoid unnecessarily obscuring the relevant description.

Embodiments of the present disclosure relate to methods and systems for detecting the presence and frequency of clipping in an audio signal using histograms with sample intervals. While other approaches aim to identify sample values in a histogram in order to detect the presence of clipping in an audio (e.g., speech) signal, the algorithm described herein detects the presence and frequency of both hard and soft clipping by comparing probabilities of particular ranges of bins in a histogram. As will be further described herein, the methods provided may be applied or implemented in any apparatus or application configured for transmitting, storing, presenting, or otherwise processing digital audio.

The distribution and number of bins in the histogram may be used to optimize the algorithm for speed and accuracy. In accordance with at least one embodiment of the disclosure, the algorithm described herein is designed to detect the presence and frequency of clipping, rather than detect the clipping value, and therefore it is not essential to have a large number of bins. However, in accordance with one or more other embodiments of the disclosure, in addition to detecting the presence and frequency of clipping, the algorithm may further be configured to determine the precise clipping value. In such other embodiments, determining the precise clipping value may be performed as post-processing (e.g., if the data in the histogram is stored). Furthermore, the bins may also be non-uniformly distributed since the number of samples belonging to lower amplitudes is of little relevance for the methods and systems described herein. For example, counting samples in certain fixed outer region amplitude intervals, which may vary depending on the particular implementation, may be equivalent to using a histogram, but with only a few bins.

Additionally, in one or more embodiments the detection algorithm of the present disclosure may be further configured to determine the severity and/or perceptual effect of any clipping found to be present in the signal by calculating the ratio of clipped samples to non-clipped samples. Temporal information on the occurrence of clipping can also be a useful indicator. For example, the impact of many clippings during one short utterance, or the same amount of clippings evenly spread out over a longer period of time, will affect the perceived quality in different ways. In general, a higher density of clipped samples may be perceptually more annoying than, for instance, a few samples clipped with seconds apart from one another. On the other hand, a one-time only occurrence of a cluster of severe clippings may be preferred over a regularly-repeated smaller click pattern.

Figure 4:
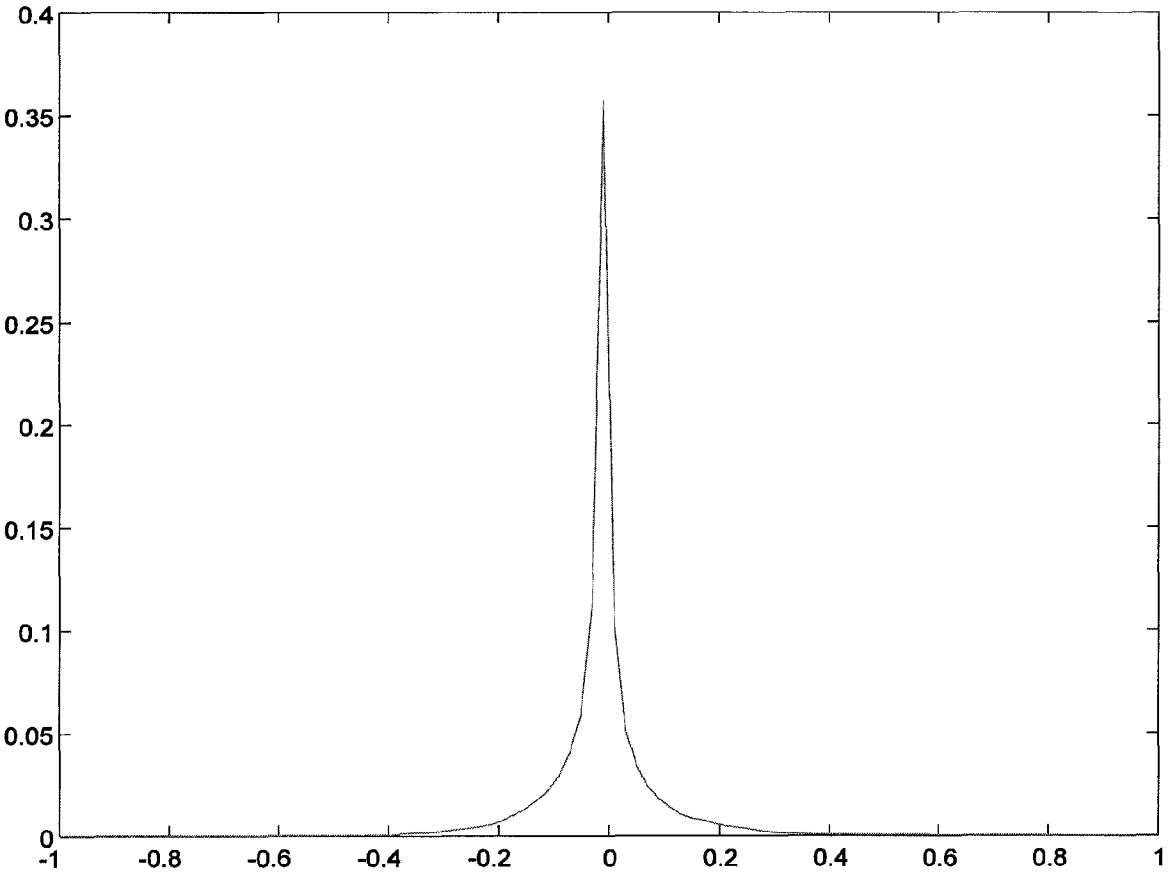
FIG. 4 is an example histogram of the undistorted speech signal shown in FIG. 1.

FIG. 4 illustrates a histogram of the undistorted speech signal shown in FIG. 1. As shown in the histogram of FIG. 4, amplitude values close to zero have relatively high probability while higher amplitude values have relatively low probability. An alternative visualization of the method described herein may be achieved using a histogram with the logarithm of the probabilities on the vertical axis.

Figure 5:
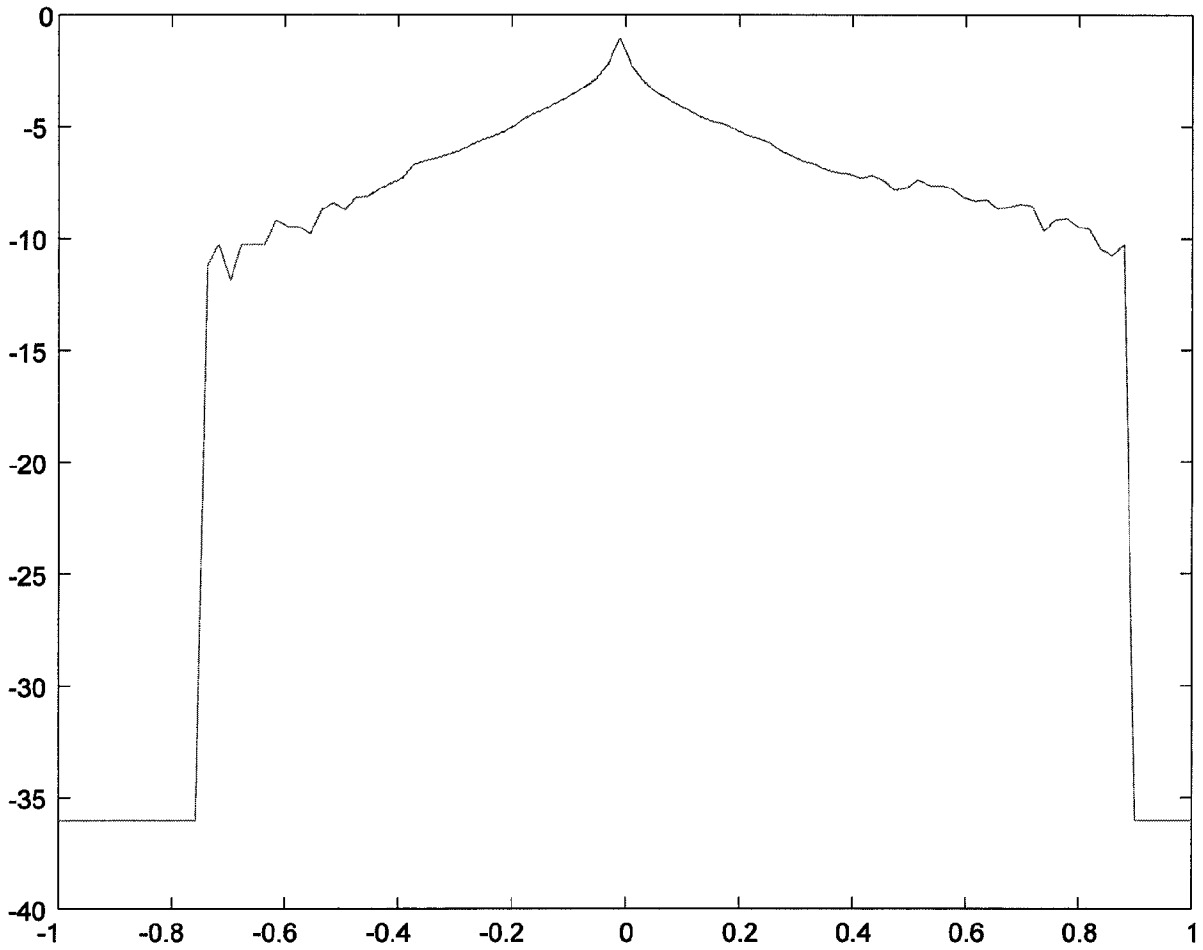
FIG. 5 is an example log-histogram of the undistorted speech signal shown in FIG. 1.

With reference to FIG. 5, illustrated is a log-histogram of the undistorted speech signal shown in FIG. 1. As can be seen from the log-histogram illustrated in FIG. 5, typically the slope of the log-probability is monotonically decreasing at the higher magnitude values.

Figure 6:
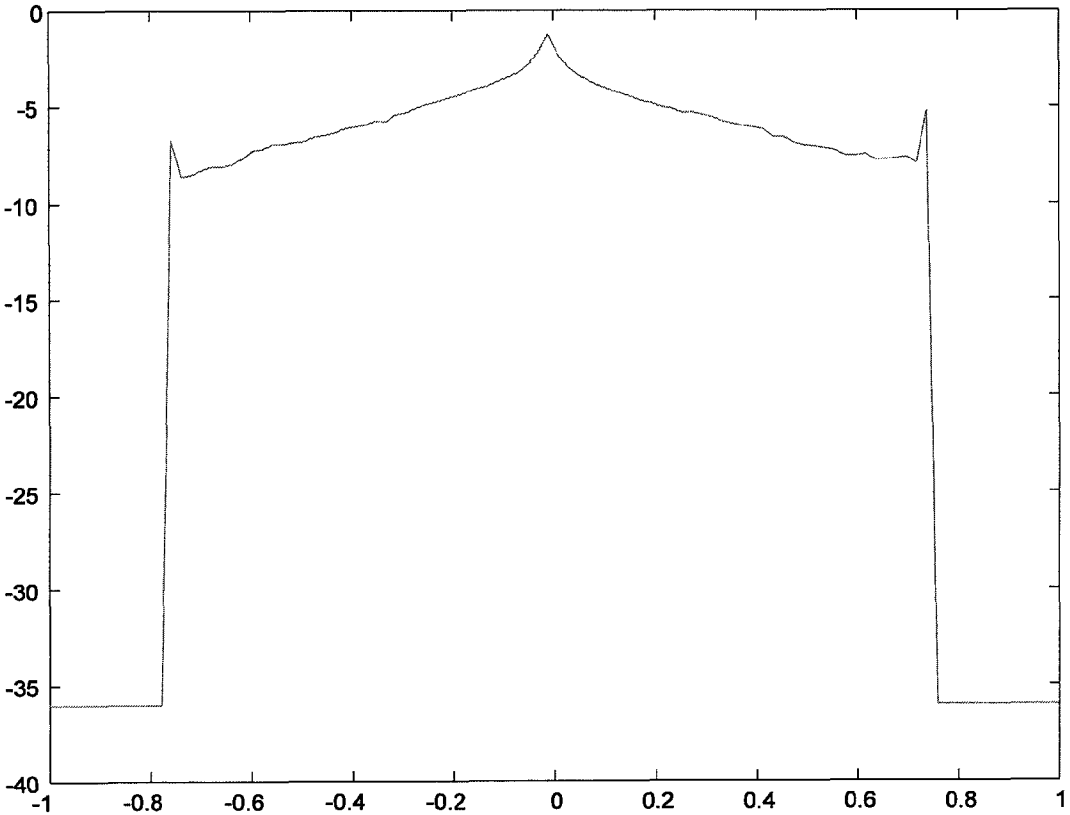
FIG. 6 is an example log-histogram of hard-clipped speech samples.

In a scenario involving hard clipping, the bins corresponding to the highest magnitude values will contain significantly more samples than the surrounding bins, resulting in spikes at the endpoints of the histogram. For example, such resulting spikes at the endpoints of the histogram are clearly visible in the log-histogram of hard-clipped speech samples shown in FIG. 6.

Figure 7:
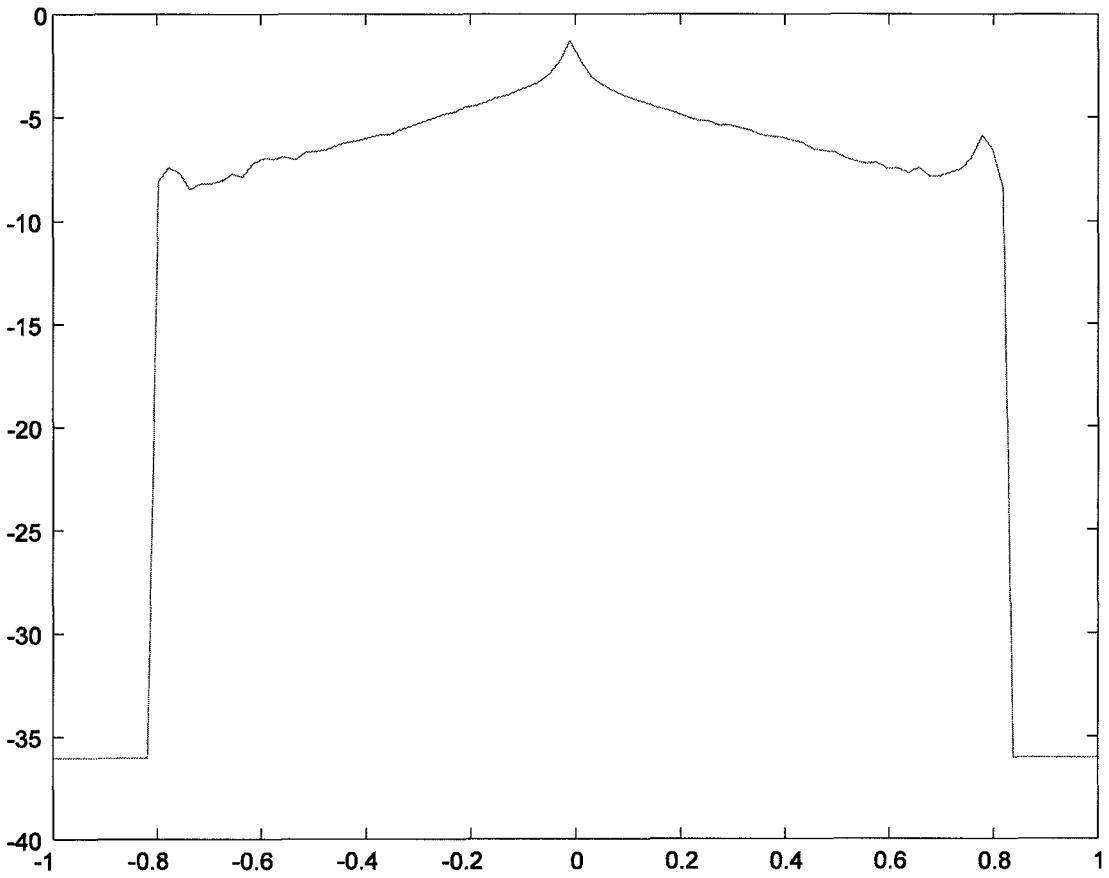
FIG. 7 is an example log-histogram of soft-clipped speech samples.

The spikes described above are relatively easy to detect. However, even in the case of soft clipping, the tails of the histogram will contain local peaks that indicate a heightened frequency of distorted/clipped samples. Such local peaks are visible in FIG. 7, which illustrates a log-histogram of soft-clipped speech samples. According to at least one embodiment described herein, both hard and soft clipping may be detected by looking for local peaks in the tails of the histogram, as will be further described below.

Figure 8:
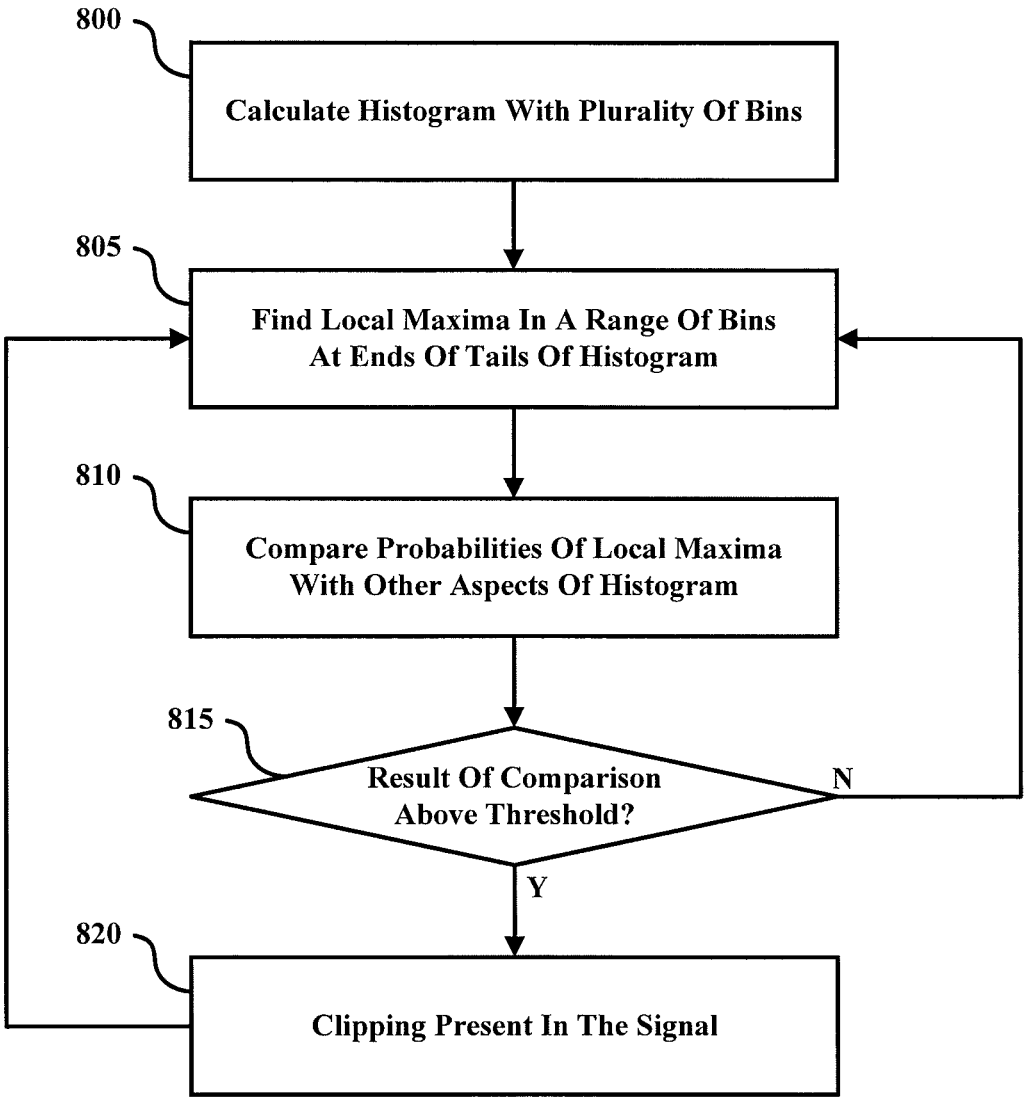
FIG. 8 is a flowchart illustrating an example process for detecting the presence and frequency of audio clipping according to one or more embodiments described herein.

FIG. 8 illustrates an example process for detecting the presence and frequency of clipping in an audio signal according to at least one embodiment of the present disclosure.

The process begins at block 800 with calculating a histogram H(x) with N bins $[x_0, x_1, \ldots, x_{N-1}]$, estimating the bin probabilities as $P(x_k) \approx H(x_k)$. In block 805, the local maxima $H_0$ in a range of R bins at the ends of the tails of the histogram may be determined.

For the upper tail of the histogram, the determination made in block 805 may include finding $$H_0^U = \max H(x), x \in \{x_{mx-R+1}, \ldots, x_{mx-1}, x_{ms}\}, \quad (1)$$

where $x_{mx}$ is the highest non-zero valued bin, $$x_{mx} = \max\{x : H(x) > 0, x \in \{x_0, x_1, \ldots x_{N-1}\}\}. \quad (2)$$

Similarly, for the lower tail of the histogram, the determination made in block 805 may include finding $$H_0^L = \max H(x), x \in [x_{mn}, x_{mn+1}, \ldots, x_{mn+R-1}], \quad (3)$$

where $x_{mn}$ is the lowest non-zero valued bin, $$x_{mn} = \min\{x : H(x) > 0, x \in [x_0, x_1, \ldots, x_{N-1}]\}. \quad (4)$$

The process moves from block 805 to block 810, where the maxima determinations made in block 805 may be compared with one or more other aspects, characteristics, or measurements of the histogram. In at least one embodiment, the maxima determinations may be compared with the probabilities (e.g., histogram values) of other bins in the histogram, such as, for example, neighboring bins in the histogram. For example, in block 810 the maxima determinations may be compared to local averages (e.g., at each of the ends of the tails of the histogram) of histogram values:

$$\overline{H^U} = \frac{1}{R} \sum_{k=mx-R+1}^{mx} H(x_k); \quad (5)$$

and $$\overline{H^L} = \frac{1}{R} \sum_{k=mn}^{mn+R-1} H(x_k). \quad (6)$$

At block 815, the results of the comparison from block 810 may be compared against one or more predetermined threshold values. In at least one embodiment, if any or both of the ratios from the comparison at block 810 are determined to be above the one or more predetermined thresholds at block 815, clipping may be detected at block 820. For example, $$\frac{H_0^U}{\overline{H^U}} > \eta^U \Rightarrow \text{clipping} \quad (7)$$

$$\frac{H_0^L}{\overline{H^L}} > \eta^L \Rightarrow \text{clipping} \quad (8)$$

Additionally, in one or more embodiments, the maxima determinations made in block 805 may be compared with local averages of log-histogram values $$\overline{H_{log}^U} = \frac{1}{R} \sum_{k=mx-R+1}^{mx} \log H(x_k) \quad (9)$$

and $$\overline{H_{log}^L} = \frac{1}{R} \sum_{k=mn}^{mn+R-1} \log H(x_k)$$

and clipping may be detected if any or both the differences are larger than some given thresholds, for example $$\log H_0^U - \overline{H_{\log}^U} > \eta_{log}^U \Rightarrow \text{clipping} \quad (10)$$

$$\log H_0^L - \overline{H_{\log}^L} > \eta_{log}^L \Rightarrow \text{clipping} \quad (11)$$

It should be noted that the detection of clipping is very valuable information for various types of audio processing. For example, clipping detection may be implemented before a digital gain control algorithm. In such an implementation, if clipping is detected at the peak value (or close to the peak value), the gain control algorithm should be very conservative in terms of amplifying the signal. Additionally, if clipping at a lower level than the peak value is detected, such information can be useful to determine that clipping detected at the output of the gain control algorithm was not caused by the gain control.

Figure 9:
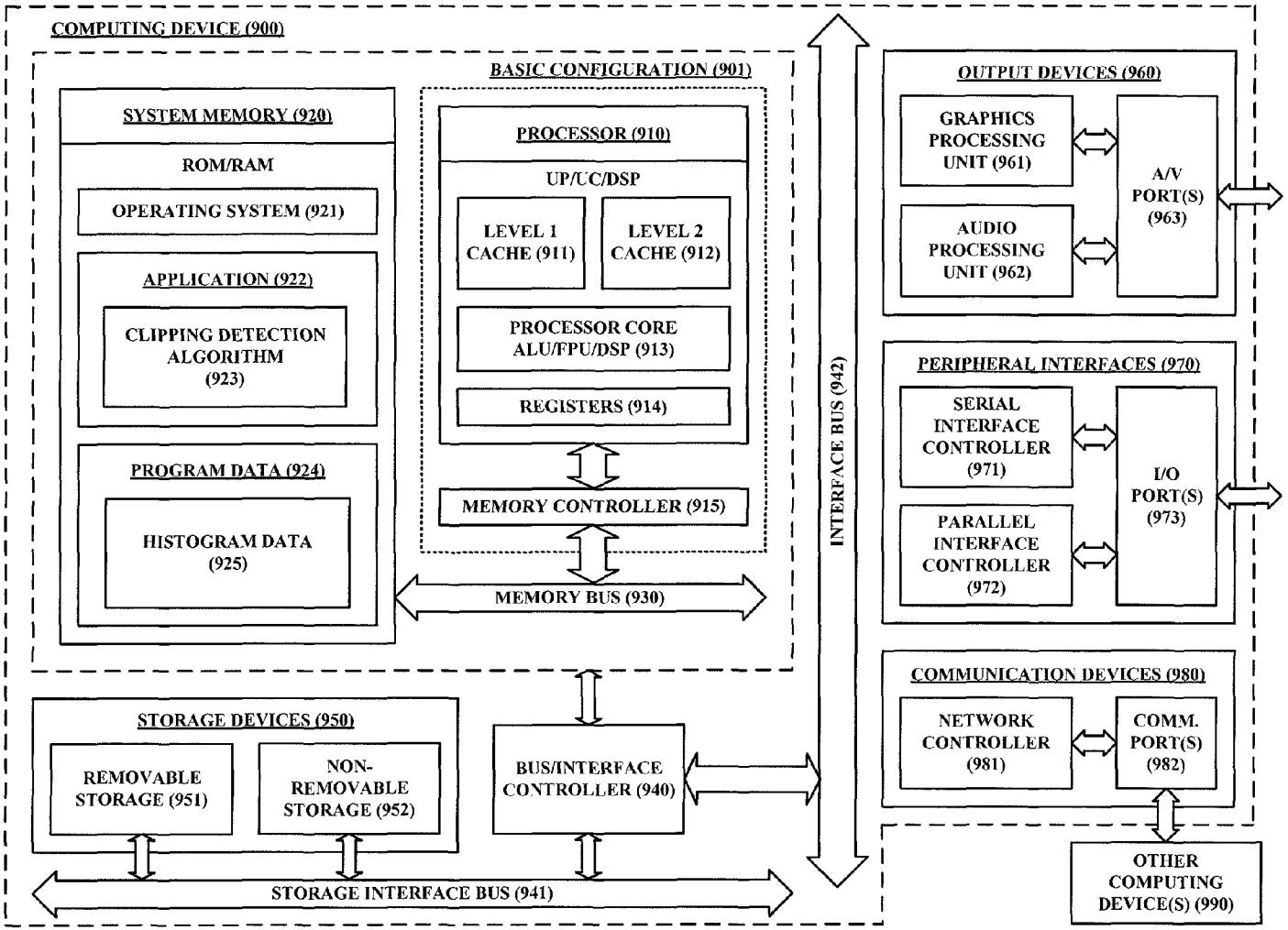
FIG. 9 is a block diagram illustrating an example computing device arranged for detecting the presence and frequency of audio clipping using histograms according to one or more embodiments described herein.

FIG. 9 is a block diagram illustrating an example computing device 900 that is arranged for detecting the presence and frequency of clipping in an audio signal using histograms with sample intervals in accordance with one or more embodiments of the present disclosure. In a very basic configuration 901, computing device 900 typically includes one or more processors 910 and system memory 920. A memory bus 930 may be used for communicating between the processor 910 and the system memory 920.

Depending on the desired configuration, processor 910 can be of any type including but not limited to a microprocessor (μP), a microcontroller (μC), a digital signal processor (DSP), or any combination thereof. Processor 910 may include one or more levels of caching, such as a level one cache 911 and a level two cache 912, a processor core 913, and registers 914. The processor core 913 may include an arithmetic logic unit (ALU), a floating point unit (FPU), a digital signal processing core (DSP Core), or any combination thereof. A memory controller 915 can also be used with the processor 910, or in some embodiments the memory controller 915 can be an internal part of the processor 910.

Depending on the desired configuration, the system memory 920 can be of any type including but not limited to volatile memory (e.g., RAM), non-volatile memory (e.g., ROM, flash memory, etc.) or any combination thereof. System memory 920 typically includes an operating system 921, one or more applications 922, and program data 924. In at least some embodiments, application 922 includes a clipping detection algorithm 923 that is configured to detect the presence and frequency of hard and/or soft clipping in an audio signal using intervals of samples in a histogram. The clipping detection algorithm 923 is further arranged to determine the severity and perceptual effect of any clipping that is present in the signal by calculating the ratio of clipped samples to non-clipped samples.

Program Data 924 may include histogram data 925 that is useful for identifying a local maximum in a range of bins at each of the tails of a histogram for a given signal, and then comparing the probability of this local maximum and its immediate neighboring bins to the probability of the surrounding bins in the histogram. In some embodiments, application 922 can be arranged to operate with program data 924 on an operating system 921 such that the comparison of these probabilities may be used to determine whether, and to what extent, clipping is present in the signal.

Computing device 900 can have additional features and/or functionality, and additional interfaces to facilitate communications between the basic configuration 901 and any required devices and interfaces. For example, a bus/interface controller 940 can be used to facilitate communications between the basic configuration 901 and one or more data storage devices 950 via a storage interface bus 941. The data storage devices 950 can be removable storage devices 951, non-removable storage devices 952, or any combination thereof. Examples of removable storage and non-removable storage devices include magnetic disk devices such as flexible disk drives and hard-disk drives (HDD), optical disk drives such as compact disk (CD) drives or digital versatile disk (DVD) drives, solid state drives (SSD), tape drives and the like. Example computer storage media can include volatile and nonvolatile, removable and non-removable media implemented in any method or technology for storage of information, such as computer readable instructions, data structures, program modules, and/or other data.

System memory 920, removable storage 951 and non-removable storage 952 are all examples of computer storage media. Computer storage media includes, but is not limited to, RAM, ROM, EEPROM, flash memory or other memory technology, CD-ROM, digital versatile disks (DVD) or other optical storage, magnetic cassettes, magnetic tape, magnetic disk storage or other magnetic storage devices, or any other medium which can be used to store the desired information and which can be accessed by computing device 900. Any such computer storage media can be part of computing device 900.

Computing device 900 can also include an interface bus 942 for facilitating communication from various interface devices (e.g., output interfaces, peripheral interfaces, communication interfaces, etc.) to the basic configuration 901 via the bus/interface controller 940. Example output devices 960 include a graphics processing unit 961 and an audio processing unit 962, either or both of which can be configured to communicate to various external devices such as a display or speakers via one or more A/V ports 963. Example peripheral interfaces 970 include a serial interface controller 971 or a parallel interface controller 972, which can be configured to communicate with external devices such as input devices (e.g., keyboard, mouse, pen, voice input device, touch input device, etc.) or other peripheral devices (e.g., printer, scanner, etc.) via one or more I/O ports 973.

An example communication device 980 includes a network controller 981, which can be arranged to facilitate communications with one or more other computing devices 990 over a network communication (not shown) via one or more communication ports 982. The communication connection is one example of a communication media. Communication media may typically be embodied by computer readable instructions, data structures, program modules, or other data in a modulated data signal, such as a carrier wave or other transport mechanism, and includes any information delivery media. A "modulated data signal" can be a signal that has one or more of its characteristics set or changed in such a manner as to encode information in the signal. By way of example, and not limitation, communication media can include wired media such as a wired network or direct-wired connection, and wireless media such as acoustic, radio frequency (RF), infrared (IR) and other wireless media. The term computer readable media as used herein can include both storage media and communication media.

Computing device 900 can be implemented as a portion of a small-form factor portable (or mobile) electronic device such as a cell phone, a personal data assistant (PDA), a personal media player device, a wireless web-watch device, a personal headset device, an application specific device, or a hybrid device that include any of the above functions. Computing device 900 can also be implemented as a personal computer including both laptop computer and non-laptop computer configurations.

There is little distinction left between hardware and software implementations of aspects of systems; the use of hardware or software is generally (but not always, in that in certain contexts the choice between hardware and software can become significant) a design choice representing cost versus efficiency tradeoffs. There are various vehicles by which processes and/or systems and/or other technologies described herein can be effected (e.g., hardware, software, and/or firmware), and the preferred vehicle will vary with the context in which the processes and/or systems and/or other technologies are deployed. For example, if an implementer determines that speed and accuracy are paramount, the implementer may opt for a mainly hardware and/or firmware vehicle; if flexibility is paramount, the implementer may opt for a mainly software implementation. In one or more other scenarios, the implementer may opt for some combination of hardware, software, and/or firmware.

The foregoing detailed description has set forth various embodiments of the devices and/or processes via the use of block diagrams, flowcharts, and/or examples. Insofar as such block diagrams, flowcharts, and/or examples contain one or more functions and/or operations, it will be understood by those skilled within the art that each function and/or operation within such block diagrams, flowcharts, or examples can be implemented, individually and/or collectively, by a wide range of hardware, software, firmware, or virtually any combination thereof.

In one or more embodiments, several portions of the subject matter described herein may be implemented via Application Specific Integrated Circuits (ASICs), Field Programmable Gate Arrays (FPGAs), digital signal processors (DSPs), or other integrated formats. However, those skilled in the art will recognize that some aspects of the embodiments described herein, in whole or in part, can be equivalently implemented in integrated circuits, as one or more computer programs running on one or more computers (e.g., as one or more programs running on one or more computer systems), as one or more programs running on one or more processors (e.g., as one or more programs running on one or more microprocessors), as firmware, or as virtually any combination thereof. Those skilled in the art will further recognize that designing the circuitry and/or writing the code for the software and/or firmware would be well within the skill of one of skilled in the art in light of the present disclosure.

Additionally, those skilled in the art will appreciate that the mechanisms of the subject matter described herein are capable of being distributed as a program product in a variety of forms, and that an illustrative embodiment of the subject matter described herein applies regardless of the particular type of signal-bearing medium used to actually carry out the distribution. Examples of a signal-bearing medium include, but are not limited to, the following: a recordable-type medium such as a floppy disk, a hard disk drive, a Compact Disc (CD), a Digital Video Disk (DVD), a digital tape, a computer memory, etc.; and a transmission-type medium such as a digital and/or an analog communication medium (e.g., a fiber optic cable, a waveguide, a wired communications link, a wireless communication link, etc.).

Those skilled in the art will also recognize that it is common within the art to describe devices and/or processes in the fashion set forth herein, and thereafter use engineering practices to integrate such described devices and/or processes into data processing systems. That is, at least a portion of the devices and/or processes described herein can be integrated into a data processing system via a reasonable amount of experimentation. Those having skill in the art will recognize that a typical data processing system generally includes one or more of a system unit housing, a video display device, a memory such as volatile and non-volatile memory, processors such as microprocessors and digital signal processors, computational entities such as operating systems, drivers, graphical user interfaces, and applications programs, one or more interaction devices, such as a touch pad or screen, and/or control systems including feedback loops and control motors (e.g., feedback for sensing position and/or velocity; control motors for moving and/or adjusting components and/or quantities). A typical data processing system may be implemented utilizing any suitable commercially available components, such as those typically found in data computing/communication and/or network computing/communication systems.

With respect to the use of substantially any plural and/or singular terms herein, those having skill in the art can translate from the plural to the singular and/or from the singular to the plural as is appropriate to the context and/or application. The various singular/plural permutations may be expressly set forth herein for sake of clarity.

While various aspects and embodiments have been disclosed herein, other aspects and embodiments will be apparent to those skilled in the art. The various aspects and embodiments disclosed herein are for purposes of illustration and are not intended to be limiting, with the true scope and spirit being indicated by the following claims.

We claim:

1. A method for detecting audio clipping, the method comprising:

calculating a histogram for an audio signal;

determining a local maximum in a range of bins of the histogram;

comparing the local maximum with at least one other characteristic of the histogram;

determining that clipping is present in the audio signal based on a ratio of the local maximum and the at least one other characteristic of the histogram exceeding a predetermined threshold value; and determining a perceptual effect of the clipping based on a ratio of clipped samples of the signal to non-clipped samples of the signal.

2. The method of claim 1, further comprising comparing the ratio of the local maximum and the at least one other characteristic of the histogram to the predetermined threshold value.

3. The method of claim 1, further comprising determining a value for the clipping in the signal.

4. The method of claim 3, wherein the determination of the value for the clipping is performed as post-processing.

5. The method of claim 1, wherein the range of bins is at an end of a tail of the histogram.

6. The method of claim 1, wherein the bins of the histogram correspond to amplitude intervals.

7. The method of claim 1, wherein the bins of the histogram are non-uniformly distributed across the histogram.

8. The method of claim 1, wherein the at least one other characteristic of the histogram is a histogram value of at least one bin outside of the range of bins.

9. The method of claim 8, wherein the histogram value of the at least one bin outside the range of bins is a local average of histogram values of bins outside of the range of bins.

10. The method of claim 1, wherein the at least one other characteristic of the histogram is a histogram value of at least one neighboring bin of the range of bins.

11. The method of claim 10, wherein the histogram value of the at least one neighboring bin of the range of bins is a local average of histogram values of neighboring bins of the range of bins.

12. The method of claim 10, wherein the histogram value of the at least one neighboring bin of the range of bins is a local average of log-histogram values of neighboring bins of the range of bins.

13. The method of claim 1, further comprising:

calculating the ratio of clipped samples of the signal to non-clipped samples of the signal.

14. The method of claim 1, wherein the perceptual effect of the clipping is determined based on temporal information about the clipping.

15. The method of claim 14, wherein the temporal information includes a number of clippings in the signal over a period of time.

16. The method of claim 14, wherein the temporal information includes a frequency of clippings in the signal over a period of time.

17. The method of claim 1, wherein the determination that clipping is present in the signal is used as a consideration in performing digital gain control on the signal.

18. A method for detecting audio clipping, the method comprising:

calculating a histogram for an audio signal;

determining a local maximum in a range of bins of the histogram;

comparing the local maximum with at least one other characteristic of the histogram; and determining whether clipping is present in the audio signal based on the comparison, wherein the at least one other characteristic of the histogram is a local average of log-histogram values of neighboring bins of the range of bins.

19. A method for detecting audio clipping, the method comprising:

calculating a histogram for an audio signal;

determining a local maximum in a range of bins of the histogram;

comparing the local maximum with at least one other characteristic of the histogram;

determining that clipping is present in the audio signal based on a ratio of the local maximum and the at least one other characteristic of the histogram exceeding a predetermined threshold value; and determining a perceptual effect of the clipping based on temporal information about the clipping.

20. The method of claim 19, wherein the temporal information includes a number of clippings in the signal over a period of time or a frequency of clippings in the signal over a period of time.

* * * * *